US005106087A

United States Patent [19]

Simmons et al.

[11] Patent Number: 5,106,087

[45] Date of Patent: Apr. 21, 1992

[54] SET OF GOLF CLUBS HAVING PROGRESSIVELY VARYING GRIP DIAMETERS

[75] Inventors: Samuel P. Simmons, Littlerock; Brian R. Jarrett, Tehachapi, both of Calif.

[73] Assignee: Tiger Shark Golf, Inc., Mojave, Calif.

[21] Appl. No.: 567,177

[22] Filed: Aug. 14, 1990

[51] Int. Cl.[5] ..... A63B 53/00

[52] U.S. Cl. ..... 273/77 A; 273/81 R

[58] Field of Search ..... 273/77 R, 77 A, 81 R, 273/81 B, 81 C, 81 D, 81.2, 81.5, 81.6

[56] References Cited

U.S. PATENT DOCUMENTS 1,648,806 11/1987 Hadden ..... 273/81.2
2,133,696 10/1938 Hall ..... 273/81 R
4,878,667 11/1989 Tosti ..... 273/81.2

OTHER PUBLICATIONS

Golf Digest, "How to Buy Equipment", Mar. 1974, pp. 54–58.

Cochran, A. and Stobbs, J., "The Search for the Perfect Swing", (Golf Society of Great Britain, 1968) pp. 213, 217.

*Primary Examiner*—Edward M. Coven
*Assistant Examiner*—William M. Pierce

[57] ABSTRACT

The grips in a set of golf clubs (both woods and irons) are made progressively greater in diameter in going from the number one iron to the sand wedge and the driver through the fairway woods, the grip diameter for each club being designed for maximum control and accuracy for that club.

13 Claims, 2 Drawing Sheets

2A
2B
2C
2D
2E
2F
2G
2H
2I
2J
2K
D

D1
D2
D3
D4
D5
D6
D7
D8
D9
D10
D11

3A
3A
3B
3B
3C
3C
3D
3D
3E
3E
3F
3F
3G
3G
3H
3H
3I
3I
D

D1
D2
D3
D4
D5
D6
D7
D8
D9

SET OF GOLF CLUBS HAVING PROGRESSIVELY VARYING GRIP DIAMETERS

BACKGROUND OF THE INVENTION

1. Field of the Invention

This invention relates to golf clubs and more particularly to a set of golf clubs having varying grip diameters which are designed for optimum power, distance, control and accuracy.

2. Description of the prior art

It has been recognized for many years that the design of the grip of a golf club is an important factor in facilitating the player's control and accuracy as well as hitting power and distance. This is pointed out, for example, in U.S. Pat. No. 4,123,055 issued Oct. 31, 1978 to Harry M. Brill. The use of the fingers and palm of the hand in achieving club control and feel is well recognized and is pointed out by such experts as Billy Casper in his book entitled The Good Sense of Golf published by Prentice Hall, Englewood Cliffs, N.J.; Peter Kostis in The Inside Path to Better Golf published by Simon Shuster, New York, N.Y.; and John Elliot in the April, 1990 issue of Golf Digest Magazine. While the diameter of the club grip is a highly significant factor in determining how the player uses his fingers and palm in controlling the club and the type of such control required varies for the swing utilized from club to club in a set, the clubs in prior art club sets are all made with the same grip diameters. Thus, the same grip size is used for a driver with which the swing uses maximum body turn and full power and a pitching wedge which employs a swing with substantially less body turn and power. While the expert golfer has generally learned to adjust his fingers and palm to compensate as need be in using the same diameter grip from club to club, such control compensation is generally not within the level of skill of the average golfer.

Each club in a set of golf clubs is designed for a primary purpose with the longer clubs being designed to hit the ball for distance and the shorter clubs being designed to hit the ball for accuracy. These are the primary purposes of such clubs.

Along with the length of a club, its loft or angle of its face also has a great influence on its distance or accuracy. For example, the #1 wood is the longest club in a set, and it also has the least loft. Both this length and lack of loft help a ball hit with a #1 wood to achieve greater distance than a ball hit with a sand wedge which has the shortest shaft and the greatest loft of any club in the set. It is to be noted that the putter which usually has the shortest shaft and only 4 degrees of loft is not considered part of a club set. Putters are not designed to match or be part of a club set; they are sold as individual clubs.

Below is a listing of the length and loft in a set of golf clubs. While individual manufacturers may vary lengths by ¼" to ½" and also vary lofts by ½" degrees to 1 degree, the lengths and lofts listed below are a general pattern for the entire golf industry for men's clubs according to Ralph Maltby in his book entitled Golf Club Repair in Pictures published by the PGA of America.

| WOODS | LENGTH | LOFT (in degrees) |
|---|---|---|
| #1 | 43" | 11 |
| #2 | 42.5" | 13 |
| #3 | 42" | 16 |

-continued

| | | |
|---|---|---|
| #4 | 41.5" | 19 |
| #5 | 41" | 22 |
| #6 | 40.5" | 25 |
| #7 | 40" | 28 |
| IRONS | LENGTH | LOFT (in degrees) |
| #1 | 39.5" | 17 |
| #2 | 39" | 20 |
| #3 | 38.5" | 24 |
| #4 | 38" | 28 |
| #5 | 37.5" | 32 |
| #6 | 37" | 36 |
| #7 | 36.5" | 40 |
| #8 | 36" | 44 |
| #9 | 35.5" | 48 |
| Pitching wedge | 35.5" | 52 |
| Sand wedge | 35.5" | 56 |

It should be apparent, therefore, that each club is designed with its own specifications to achieve its principal goal. The present invention is directed to providing a grip size which will also contribute to achieving this goal. It is to be noted that clubs designed for women have the same lofts as for men but generally are 1" shorter than comparable men's clubs.

SUMMARY OF THE INVENTION

The present invention provides a set of golf clubs in which the grip of each club in the set is given a different diameter for both control and accuracy as well as hitting power and distance in the use of the club. The diameter for the grip of each club in a set is determined with the following considerations in mind. In using a golf club a lever arm is formed between the player's wrist and the point at which the player grips the club. In view of the fact that a golfer tends to grip a smaller diameter club more in his fingers than his palm, a smaller diameter club grip makes for a longer lever arm with greater resultant power and distance from the swing. Therefore with the lower numbered clubs where distances and power are the primary objectives, a smaller diameter club grip is called for. On the other hand with the medium and short irons(higher numbered clubs), where power is of less import and accuracy is more important, greater diameter club grips which facilitate greater gripping action by the player's palm are called for. Thus, the diameter of each club grip in a set of clubs is designed to provide optimum performance of the club for its intended purpose.

It is therefore an object of this invention to provide a set of golf clubs in which the grip diameter of each club is individually designed for optimum performance.

Other objects of the invention will become apparent from the following description taken in connection with the accompanying drawings.

DETAILED DESCRIPTION OF THE INVENTION

Figures 1, 2, 2A, 2B, 2C, 2D, 2E, 2F, 2G, 2H, 2I, 2J, 2K:
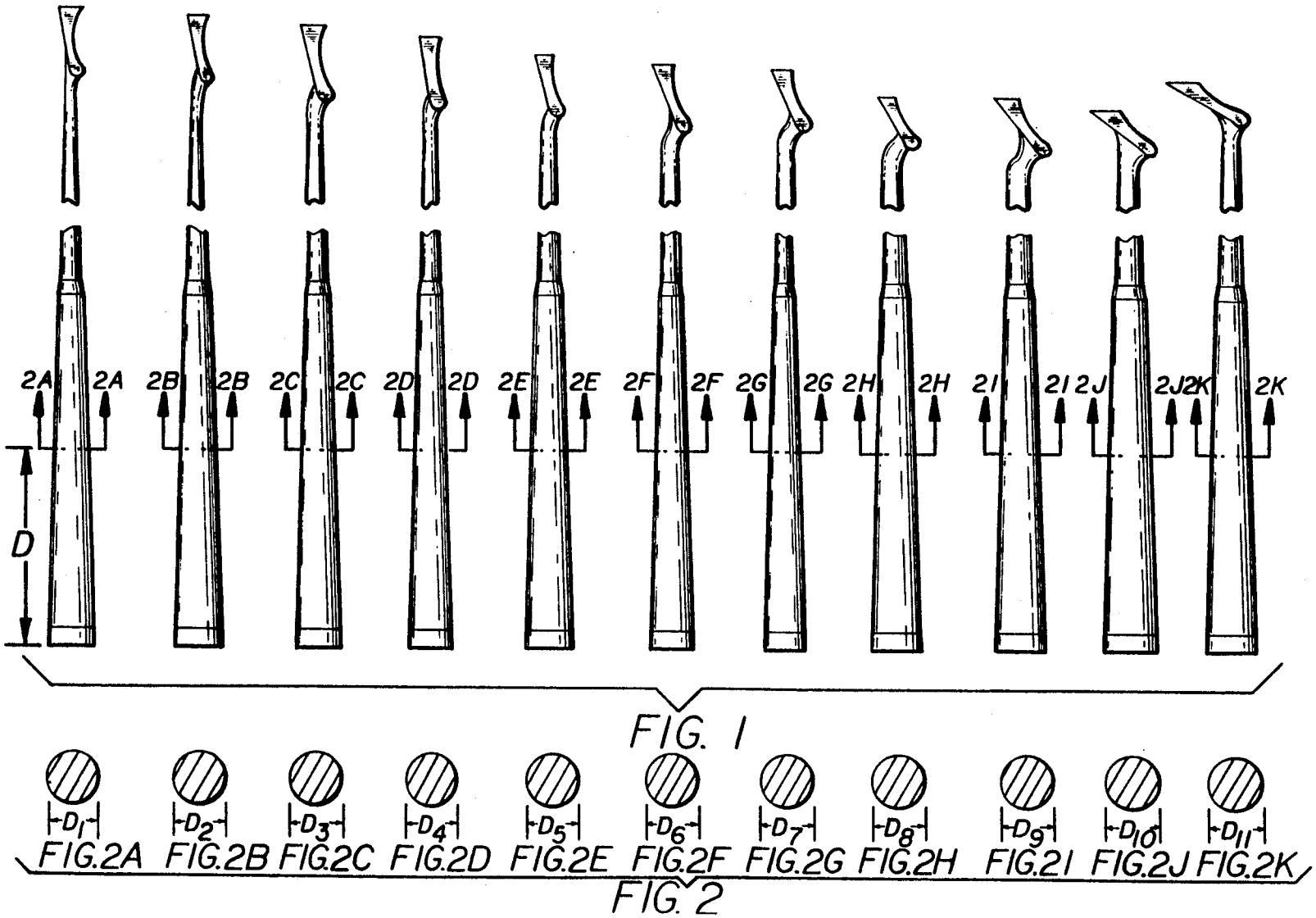
FIG. 1 illustrates a set of golf club irons incorporating the invention.
FIG. 2 shows cross sectional views of each of the grips of the clubs of FIG. 1 taken along the planes indicated in FIG. 1.
Figures 3, 3A, 3B, 3C, 3D, 3E, 3F, 3G, 3H, 3I, 4:
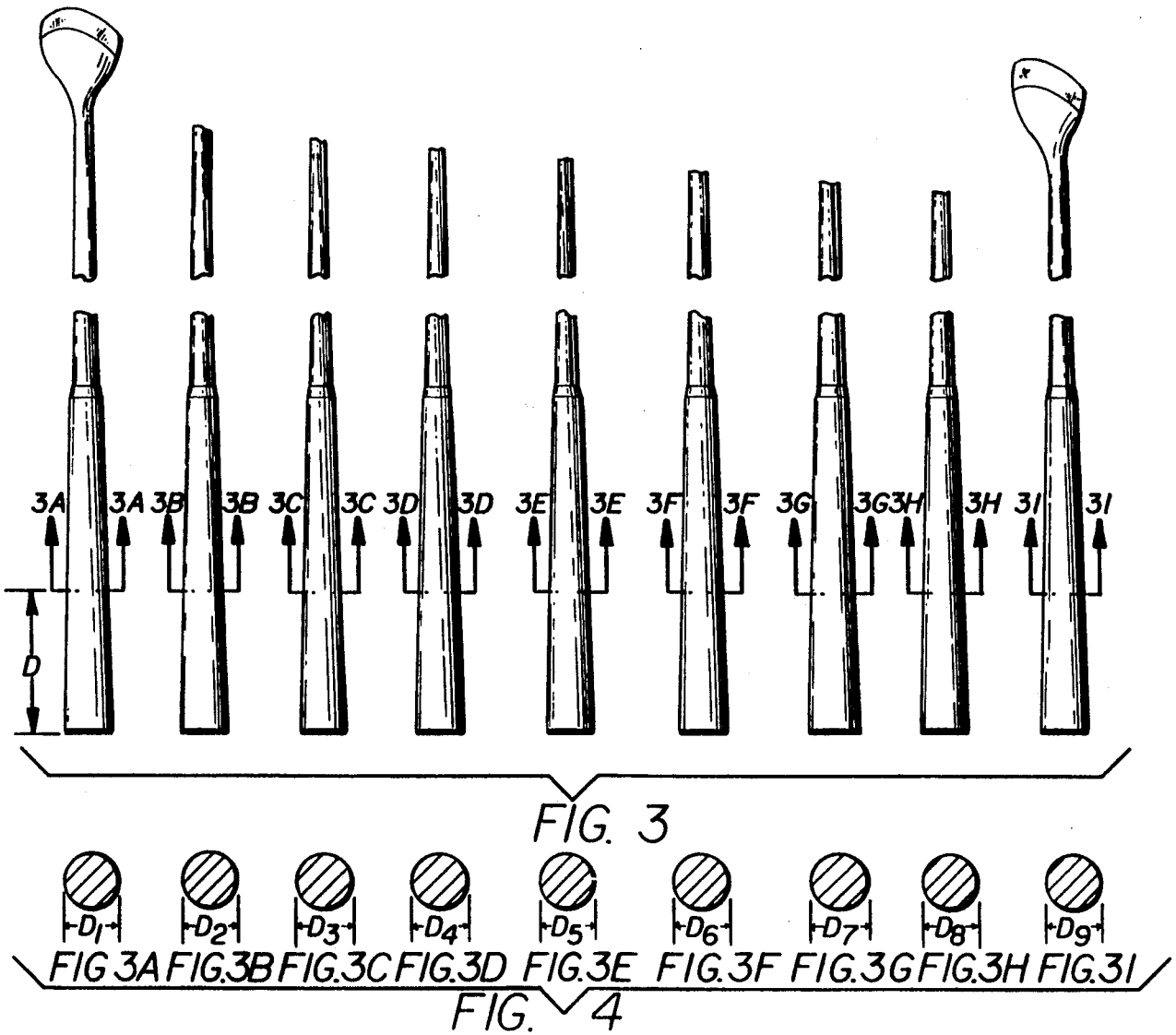
FIG. 3 illustrates a set of golf club woods incorporating the invention.
FIG. 4 shows cross sectional views of each of the grips of the clubs of FIG. 3 taken along the planes indicated in FIG. 3.

Referring now to FIGS. 1 and 2, a set of golf club irons incorporating the invention is shown. The diameters $D_1$–$D_{11}$ of the grips of the clubs progressively increase in size in going from the number 1 iron to the wedges(PW and SW). In the first embodiment, this increase is a straight line progression. A non-linear progression, however, may also be utilized. While a straight-line progression in grip size is desirable and most effective for most players, top quality amateur golfers and professionals will benefit most from grip sizes which increase somewhat variably from club to club. In this non-linear progression, the greatest increase in diameter occurs between the number 1 and number 2 clubs with this increase being reduced slightly between succeeding numbered clubs. It is also to be noted that certain golfers in the "average" category may find the clubs with non-linear grip size increases to be more comfortable and to provide the desired optimum performance while certain professionals may prefer the clubs with linear grip size increases.

The following grip diameters as measured at a distance, "D"(See FIG. 1) which is two inches from the top of the grip cap are employed in the first embodiment for the number 1 club in each of the following categories as follows:

Man's Grip —0.890 inches

Woman's Grip—0.870 inches

In the first embodiment, the diameters $D_1$–$D_{10}$ of the club grips increase in a linear progression from club to club by 0.009 inches. The two wedges, PW and SW are given the same diameters in view of the great similarity between the shots made with these two clubs.

In the clubs having a non-linear progression, the amount of grip size increase does not remain constant but is reduced slightly with each club as we progress from the number 2 clubs through the remaining clubs in the set.

It is also to be noted that the same grip sizes are used on similarly numbered woods and irons.

The grip sizes for the various embodiments of the invention for an average male golfer as as follows:

| CLUB NO. | LINEAR PROGRESSION SIZE (both iron and wood) | LINEAR PROGRESSION PROG. | NON-LINEAR PROGRESSION SIZE | NON-LINEAR PROGRESSION PROG. |
|---|---|---|---|---|
| 1 | .890 in. | 0 | .890 in. | 0 |
| 2 | .899 | .009 | .903 | .013 |
| 3 | .908 | .009 | .915 | .012 |
| 4 | .917 | .009 | .926 | .011 |
| 5 | .926 | .009 | .936 | .010 |
| 6 | .935 | .009 | .945 | .009 |
| 7 | .944 | .009 | .953 | .008 |
| 8 | .953 | .009 | .960 | .007 |
| 9 | .962 | .009 | .966 | .006 |
| PW & SW | .971 | .009 | .971 | .005 |

For an average women golfer or for golfers having larger or smaller than average size hands, the progressions from club to club for both the linear and non-linear progressions are the same as given above for an average male golfer; however, the grip diameter of the number one club will differ for those having larger or smaller hands. As indicated above, the number one club for an average women golfer will have a grip diameter of 0.870 in. The grip diameter of the number 1 club for all golfers may vary between 0.800 and 1.100 in., depending on the size of the hands.

Each grip diameter in a set of clubs is thus made to a different dimension for the particular club so as to afford the desired control and accuracy or power and distance as the case may be.

While the invention has been described and illustrated in detail, it is to be clearly understood that this is intended by way of illustration and example only and is not to be taken by way of limitation, the scope of the invention being limited only by the terms of the following claims:

We claim:

1. A set of golf clubs, comprising:

a plurality of different clubs identified respectively by a progression of small to large identification numbers, each of said clubs having an elongated shaft with a head at one end thereof and defining a handle generally at an opposite end thereof, said head of any one of said clubs being different than said head of each of the remaining ones of said clubs; and a plurality of generally tubular grips having a progression of different small to large external diameters, said grips being mounted respectively onto said club handles in a sequence with the smallest diameter grip mounted onto the handle of the lowest numbered club, and with each consecutively numbered pair of clubs having a slightly larger diameter grip on the handle of the higher numbered club.

2. The set of golf clubs of claim 1 wherein said shafts of said clubs each have a different length, with said lowest numbered club having the longest shaft, and with each consecutively numbered pair of clubs having a slightly shorter shaft on the higher numbered club.

3. The set of golf clubs of claim 1 wherein said heads of said clubs each have a hitting face defining a different loft angle, with said lowest numbered club having a hitting face with the smallest loft angle, and with each consecutively numbered pair of clubs having a hitting face with a slightly greater loft angle on the head of the higher numbered club.

4. The set of golf clubs of claim 3 wherein said shafts of said clubs each have a different length, with said lowest numbered clubs having the longest shaft, and with each consecutively numbered pair of clubs having a slightly shorter shaft on the higher numbered club.

5. The golf club set of claim 1 wherein said set of clubs includes nine clubs numbered successively 1–9, the grip diameters of said clubs as measured approximately two inches from the top of the grip cap increasing in a non-linear progression from club to club starting at the number 1 club.

6. The set of clubs as set forth in claim 5 wherein the grip diameter of said number 2 club is approximately 0.013 inches greater than that of said number 1 club, the grip diameter of said number 3 club is approximately 0.012 inches greater than that of said number 2 club, the grip diameter of said number 4 club is approximately 0.011 inches greater than that of said number 3 club, the grip diameter of said number 5 club is approximately 0.010 inches greater than that of said number 4 club, the grip diameter of said number 6 club is approximately 0.009 inches greater than that of said number 5 club, the grip diameter of said number 7 club is approximately 0.008 inches greater than that of said number 6 club, the grip diameter of said number 8 club is approximately 0.007 inches greater than that of said number 7 club, and the grip diameter of said number 9 club is approximately 0.006 inches greater than that of said number 8 club.

7. The set of clubs of claim 6 further including PW and SW wedge clubs both of which have a grip diameter which is approximately 0.005 inches greater than that of said number 9 club.

8. The set of golf clubs of claim 1 wherein the diameters of the grips of said clubs as measured at a distance substantially two inches from the tops of the caps of said grips increasing progressively from club to club starting at the lowest numbered club by approximately 0.009 inches.

9. The set of clubs of claim 2 wherein the clubs of said set are all irons.

10. The set of clubs of claim 2 wherein the clubs of said set are all woods.

11. The set of claim 11 wherein the grip diameter of the lowest numbered club of said set is 0.800–1.100 inches.

12. The set of claim 8 wherein said set includes clubs numbered 1 through 9.

13. The set of claim 12 further including wedge clubs designated as PW and SW both of which have the same grip diameter which is approximately 0.009 inches greater than that of the number 9 club.

* * * * *

UNITED STATES PATENT AND TRADEMARK OFFICE

CERTIFICATE OF CORRECTION

PATENT NO. : 5,106,087

DATED : Apr. 21, 1992

INVENTOR(S) : Simmons et al.

It is certified that error appears in the above-identified patent and that said Letters Patent is hereby corrected as shown below:

In the Claims, Column 6, line 7, the reference numeral "11" should read --8--, insert --of clubs-- after "The set"; line 10, insert --of clubs-- after "The set"; line 12, insert --of clubs-- after "The set".

Signed and Sealed this

Twenty-first Day of September, 1993

Bruce Lehman

*Attest:*

BRUCE LEHMAN

*Attesting Officer*

*Commissioner of Patents and Trademarks*